United States Patent [19]

Lloyd

[11] Patent Number: 5,024,257

[45] Date of Patent: Jun. 18, 1991

[54] WOODWORKING MACHINE

[76] Inventor: James E. Lloyd, Rte. #1, Tremont, Ill. 61568

[21] Appl. No.: 492,755

[22] Filed: Apr. 18, 1990

[51] Int. Cl.[5] ..... B27C 9/00

[52] U.S. Cl. ..... 144/1 R; 144/134 A; 144/286 R; 409/205; 409/229

[58] Field of Search ..... 144/1 R, 3 R, 134 A, 144/286 R, 286 A, 287; 409/204, 205, 214, 228, 229

[56] References Cited

U.S. PATENT DOCUMENTS

| | | | |
|---|---|---|---|
| 3,209,800 | 10/1965 | Liebow | 409/228 |
| 3,604,484 | 9/1971 | Vijoen | 144/134 A |
| 3,734,151 | 5/1973 | Skripsky | 144/1 R |
| 4,209,045 | 6/1980 | Bassett | 144/286 R |
| 4,887,653 | 12/1989 | Thomas | 144/1 R |

*Primary Examiner*—W. Donald Bray
*Attorney, Agent, or Firm*—Thomas E. Frantz

[57] ABSTRACT

A woodworking machine attachable to a table saw, the machine being adapted to readily accept and release yet securely hold a mounting plate on which a router is releasable secured. The machine includes mechanism which is manually actuated to effect controlled movement of the tool relative to either a rip fence which is selectively positioned on the table or a miter gauge slidable along a groove extending across the table. The rip fence or miter gauge is effective to prevent backlash and vibration of a work piece as one edge of the work piece is fed into cutting engagement with the router bit while the opposite edge of the work piece is in operative engagement with the fence or miter gauge.

23 Claims, 5 Drawing Sheets

WOODWORKING MACHINE

The present invention relates generally to woodworking equipment and more particularly to a woodworking machine embodying a unique system which not only provides for the support of a work piece against backlash, vibration and "float" as it is acted upon by a cutting tool but permits both rapid insertion/removal of the tool and precise finite adjustment of the tool relative to the work piece support. The machine may be used either independently or in combination with another tool, such as a table saw.

BACKGROUND OF THE INVENTION

Particularly in a home or small commercial woodworking shop the need for and frequency of shaping the edges of boards is seldom sufficient to warrant the significant investment necessary to procure a heavy duty commercial floor type spindle shaper and the cutters and various accessories which are required to fully utilize such a machine. As a result, when it becomes necessary in such a shop to shape the edges of a few boards, the usual expediency is to mount a hand router on the bottom of a small counter top type of router table, with the cutter projecting through a centrally located hole in the table. The top of the table normally is equipped with a fence consisting of two pieces which are spaced on opposite sides of the cutter and which must be aligned—usually with some difficulty—with one another and with the periphery of the cutter. The boards are then pressed against the fence as they are slowly fed into engagement with the rotating cutter.

Anyone who has used an arrangement of the type described above will recognize the difficulties normally encountered in attempting to obtain acceptable results.

First, as the usual counter top type of router table is quite light it will move readily under the pressures normally needed to keep a work piece tightly against the two piece fence while at the same time pushing the work piece into the rotating cutter. In addition to these pressures, the high frequency vibrations which are transmitted to the table from the rapidly rotating parts of the router will, in themselves, sometimes cause a machine to "creep". In almost all instances, therefore, these lightweight router tables must be bolted or clamped to a heavy stationery work bench or table. This, of course, will solve the problem of undesired movement, but at the expense not only of raising the top of the router table to a height which is both awkward and unsafe but the loss of valuable bench-top space so long as the router table is kept ready for use.

Even with the usual router table suitably anchored and located at a comfortable working height, it is difficult to obtain a smooth ripple free and blemish free finish. As pointed out above, the two sections of the usual router fence are not only difficult to properly align with each other and with the cutter but their use leads to various other problems. For example

- even if the fence sections appear to be aligned it is not unusual in feeding the end of a board into the cutter to catch the end of the board on the edge of the fence immediately beyond the cutter, causing the board to stop and/or jump, resulting in a hump, gouge or "burn" on the machined edge at that point;
- particularly when machining a short board or taking an "end" cut, before the unsupported end of the board has bridged the gap between the fence sections, a slight "glitch" in the manual pressure used in moving the board past the cutter often times will cause the unsupported end of the board to dip momentarily into the gap, thus resulting in too deep a cut at that point;
- in making a cut which reduces the width of the board as it passes the cutter, if the fence section beyond the cutter is not moved forward a distance exactly equal to the amount of material to be removed—a procedure which is difficult at best—the board coming out of the cutter will not be held straight and a defective cut will result as pressure is transferred to the second fence section near the end of the cut;
- as there is no positive control of the movement of the fence sections, it is exceedingly difficult and time consuming to re-set the fence sections to remove a few thousandths of an inch of material as, for example, to accomplish a press fit between pieces;
- the small area of the router table is incapable of supporting work pieces of any substantial length or width;
- in spite of the application of considerable force in pressing a work piece toward the two section fence while feeding the work piece into the cutter, it is difficult to avoid—particularly with hardwoods—the generation of a machined edge which does not show ripples resulting from the "floating" effect caused by high frequency vibration of the work piece as the high speed cutter encounters and bites into the moving work piece;
- the pressure needed to reduce the effect of the vibration and "float" of a moving work piece is not conducive to a smooth even feed of the work piece into the cutter but to the contrary tends to cause a "jerky" or uneven feed;
- as the "floating" effect caused by the high speed cutter tends to keep a moving work piece suspended slightly from the router fence, any slow down or stoppage in the rate of movement of the cutter will cause a slightly deeper cut or gouge and hence an uneven machined surface, including burns and ripples;
- due to a lack of space between the lower surface of the router table and the upper section of the router attached thereto, it is difficult, awkward and time consuming to release and tighten the collet or other mechanism as required to change a router bit;
- should the worker be using his hands rather than some type of pushing device to push a work piece past the router cutter, inadvertent slippage of the fingers off the work piece can lead to serious injuries since the two pressures being exerted on the work piece combine on a vector which is aimed almost directly at the cutter.

Over the years, various suggestions have been proposed for solving one or more of these types of problems in a machine sized and priced for the home and small shop market. As far as is known, however, prior to the present invention, none of the many tool manufactures in the industry have been successful in designing, developing and selling a router machine which is reasonably priced and sized, is safe and convenient in use and successfully eliminates most if not all of the other problems described above.

SUMMARY OF THE INVENTION

The present invention provides a new and unique woodworking machine utilizing a motorized hand type router. The router not only is easily and conveniently placed in and removed from the machine, but its position is readily adjusted while mounted in the machine. The machine does not employ the usual two piece router fence straddling the cutter. Rather, it provides for use of a guide which is selectively positionable remote from the cutter such that the work piece is positioned between the guide and the cutter as it is being fed into and shaped by the cutter. The pressures generated by the cutter as it bites into the advancing work piece thus tend to force the work piece away from the cutter and against the guide. Not being movable under such pressures, the guide will restrain the work piece against any movement away from the cutter or the backlash and vibrations which would otherwise occur as a result of the high frequency at which the cutter impacts on the work piece.

In addition to the advantages provided by positioning the work piece against the guide between the guide and the cutter, the present invention includes structure which permits quick and convenient yet precisely controlled movement of the router/cutter relative to the guide. Thus, the edge of a work piece can be machined gradually through a series of small steps should the wood be extremely hard or for some other reason, as to obtain a close fit between parts, the routing needs to be done in very small controlled increments. In effect, therefore, the guide can be used to provide an initial coarse setting for the first cut, and the router/cutter then moved transversely toward the guide to such position or in such increments as may be necessary to complete the routing job.

The machine of the present invention can be provided with a table which is sufficient in terms of size, weight, and guide support means to permit its use alone as an individual entity. For several reasons to be discussed below, however, it is preferable to combine the present machine with a table saw—mounting the machine on one end of the table saw in place of one of the extensions normally bolted to each side of a table saw to increase its work area. Obviously, the work surfaces of the table saw and router machine should be positioned in a coplanar relationship to provide as large a continuous work surface as possible. Best results are obtained when the present machine is mounted (facing the front of the saw) on the right hand edge of the saw table. Following are some of the advantages found to result from the combination of the present router machine with a table saw of the usual construction.

The overall size of the combined machines is little if any greater than that of the saw alone.

The router machine is held at a comfortable safe working height.

There is no danger of inadvertent movement of the router machine during normal use because of the weight and stability of the table saw.

The guide means (rip fence and miter gauge) of the saw can be used for both the saw and router operations, thus serving double duty.

In many cases the power cord of the router can be plugged into and controlled by the switch box of the saw in place of the power cord of the saw motor.

The work area for the router machine is considerably expanded without any sacrifice in the work area available for the saw as the router is easily removed from the machine, thus leaving a clear unencumbered surface for the saw.

These and other features and advantages are provided by a router machine having a flat rectangular table with an elongate opening or slot extending transversely relative to and through one edge of the table. A hand type motorized router is secured on the bottom face of a relatively rectangular mounting plate, with the router bit or cutter projecting upwardly through an aperture in the plate.

Fixed beneath the table is structure for releasably supporting the mounting plate proximate the lower surface of the table, with the cutter projecting upwardly through the table slot. This support structure includes a pair of support members spaced apart on opposite sides of the slot for engagement with opposite edges of the mounting plate to restrain the plate and router against movement transversely of the slot.

Proximate the back or inner end of the support members is a stop for limiting inward movement of the mounting plate as the plate and attached router are assembled with the machine. At the front or outer end of the support members is a closure which, when latched, restrains the mounting plate and router against movement longitudinally of the slot and which, when open, permits the mounting plate and router to be easily inserted into and removed from the machine. Thus, the router and mounting plate can be removed from the machine quickly, easily and conveniently to clear the table, to change the cutter, or for other purposes.

The support members are mounted on and movable with a pair of follwers which, in turn, are mounted on and movable longitudinally relative to a pair of track sections.

The track sections are fixed beneath the table on opposite sides of the slot, and positioned such that when the followers, support members, mounting plate and router are moved conjointly longitudinally along the track sections the cutter will move along the table slot.

Movement of the followers and associated components is effected in a very precise controlled manner in response to manual rotation of a hand wheel and associated threaded drive member. Rotation of the threaded drive member is translated to longitudinal movement of the followers and associated components by a suitable threaded take-off nut and connecting linkage.

Should it be desired to use the router machine as a separate individual piece of equipment, it will require structure for supporting the guide or guides which, in turn, support a work piece against vibration and movement away from the cutter as it is being routed. To provide for use of a rip fence type of guide, an elongate rail should be connected along either one or both sides of the table perpendicular to the side through which the slot extends. The fence is then positioned across the table in sliding engagement with the rail(s). It can thus be moved along the table to a selected position, and releasably clamped to the rail(s) to provide a stable support for a work piece as it slides along the fence into engagement with the router cutter.

For a guide in the form of a miter gauge, the table of the machine will require a groove extending thereacross perpendicular to the slot. As is well known, the usual miter gauge includes an elongate bar sized to slide in a groove and a rotatable head portion carried by the bar. In the present invention the head portion, or an extension carried by the head portion, preferably is provided with a stop which is movable along and selectively fastened to the head portion or its extension in such position as to abut the end or edge of the work piece to be routed. The fixed stop thus, in effect, forms a moving guide for the work piece as it and the miter gauge are moved across the table in sliding engagement with the groove.

As the present router machine will in most instances be mounted on a table saw, it will be adjacent to one of the miter gauge grooves normally provided adjacent to each edge of the primary table section of the table saw. Accordingly, generally it will not be necessary to provide a miter gauge groove directly in the table of the router machine; such a groove would be redundant and unnecessary.

In some cases, however, a user may not wish to mount the router machine on a table saw but rather use it as a separate piece of equipment. In such cases, the router machine could be offered with a somewhat deeper table and a miter gauge groove. Such an extension and groove would be unnecessary and even detrimental, though, if the user should later decide to mount the router machine on a table saw. To avoid this potential problem, in the illustrated embodiment there is provided a supplemental table which has a miter gauge groove and which normally would be mounted on the router machine should the machine not be mounted on a table saw. Thus, by provision of the supplemental table, the router machine can be adapted readily either for attachment to a table saw or for use as a separate machine.

OBJECTS OF THE INVENTION

It is a principal object of this invention to provide an improved router machine.

It is a further object of this invention to provide a router machine wherein the router is selectively movable to vary the distance between the router cutter and a fixed guide.

Yet an additional object of this invention is the provision of an improved router machine adapted to be mounted on a table saw.

A still further object of this invention is to provide a router machine adapted to quickly, easily and conveniently receive, releasably hold and selectively release a hand type router.

Another object of this invention is the provision of an improved wood working machine wherein the functions of a table saw and a router are integrated and combined in a new and unique manner.

A still further object of this invention is to provide a router system which is safer and much easier and more convenient to work with than the usual router table system yet which provides greater accuracy and far superior results.

Yet a further object of this invention is to provide a router machine wherein the work piece guide is positioned remote from the cutter and the cutter is movable relative to the guide to control the depth of cut on the work piece.

The above and other objects, features and advantages of this invention will be apparent from the following description when read in conjunction with the accompanying drawings.

DETAILED DESCRIPTION OF THE DRAWINGS

Figure 1:
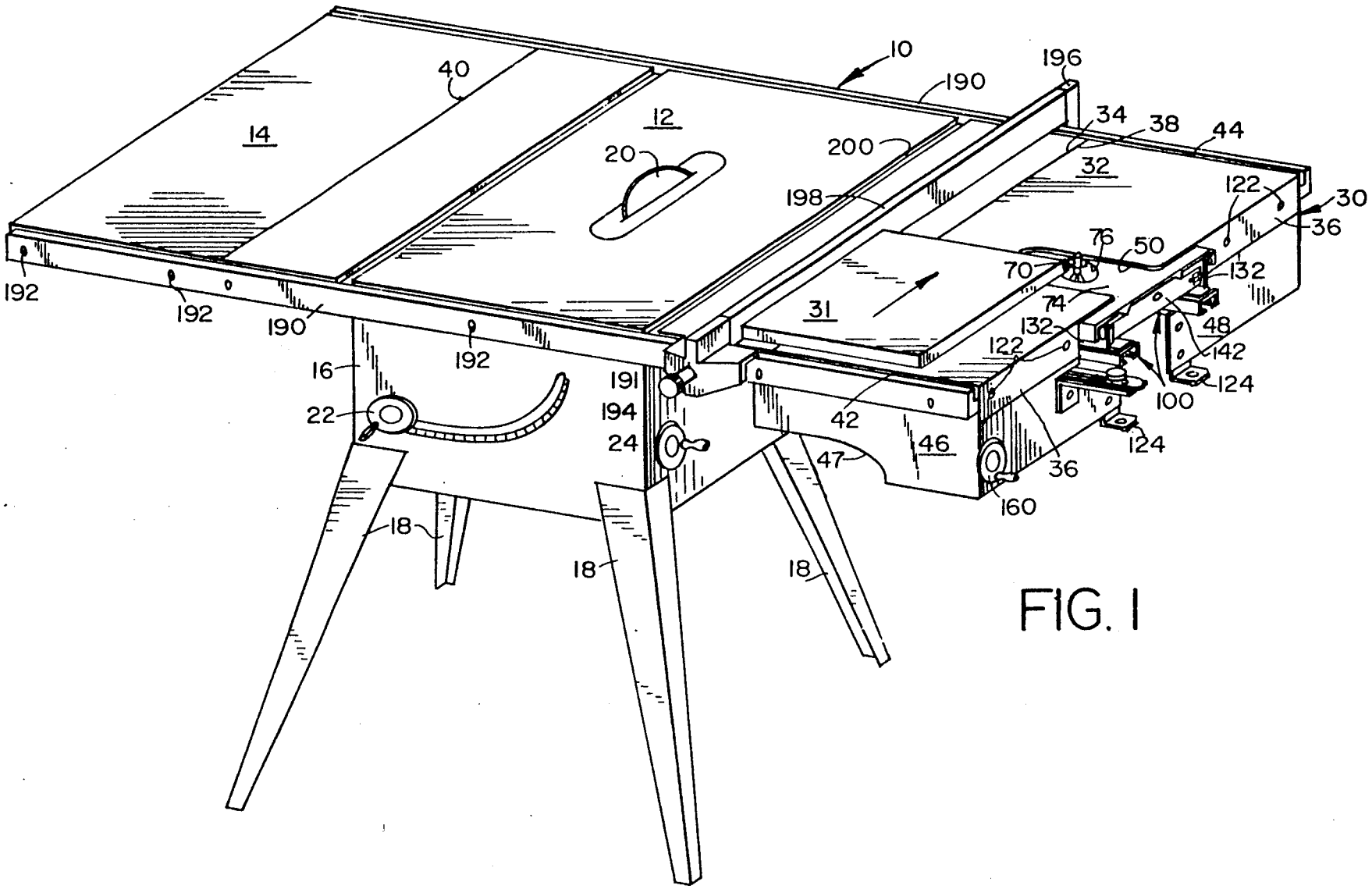
FIG. 1 is a perspective view of a woodworking machine according the present invention mounted on and combined with a table saw, there being a work piece positioned against the fence for advancement into the cutter of the machine.

Continuing now with a more detailed description of the drawings, reference is first made to FIG. 1, showing a conventional table saw 10 having the usual rectangular table 12, table extension 14, base 16 and legs 18. The elevation and tilt of the saw blade 20 are controlled through the use of the normal worm gear/rack and trunnion assemblies (not shown) which, in turn, are controlled by the manually rotatable elevation wheel 22 and tilt wheel 24. Rotation of the saw blade 20 is effected by an electric motor with the usual "V" belt drive.

Mounted on one edge of the saw table 12 is a woodworking machine 30 constructed in accordance with a preferred embodiment of the present invention and provided with a work piece 31 positioned for movement into the cutting element (to be described hereafter) of the machine. The machine 30 comprises a generally rectangular table 32 having inner and outer vertical edges 34 and 36 of a length substantially equal to the side edges 38 and 40 of the saw table 12. The other two vertical edges—front edge 42 and back edge 44—of the machine table 32 are somewhat shorter than inner and outer edges 34 and 36. Although the width of vertical edges 34, 36, 42 and 44 is not of critical importance, preferably it is in the range of 1.5" to 2" (3.81 mm to 5.08 mm) to provide both good rigidity to the table and adequate space for convenient attachment of "L" shaped skirt portions 46 and 48.

While machine table 32 may be formed as an iron or aluminum casting, in the present embodiment it is fabricated from sheet steel of about 0.125" (3.175 mm) thickness. If table 32 is stamped in finished shape, the vertical edges will, of course, be integrally connected at the corners to provide a continuous reinforcing or stiffening "frame" around the periphery of the table. Otherwise, if the edges are bent individually from the flat stock used for table 32, preferably they are welded together at the corners to provide the desired continuous reinforcing or stiffening "frame".

An elongate opening or slot 50 is stamped or cut in table 32, this slot 50 being positioned transversely of and extending through outer edge 36. As will be noted particularly from FIGS. 1 and 3, the vertical outer edge 36 is cut back some distance on each side of slot 50 for a purpose which will become obvious from the following description.

Figure 6:
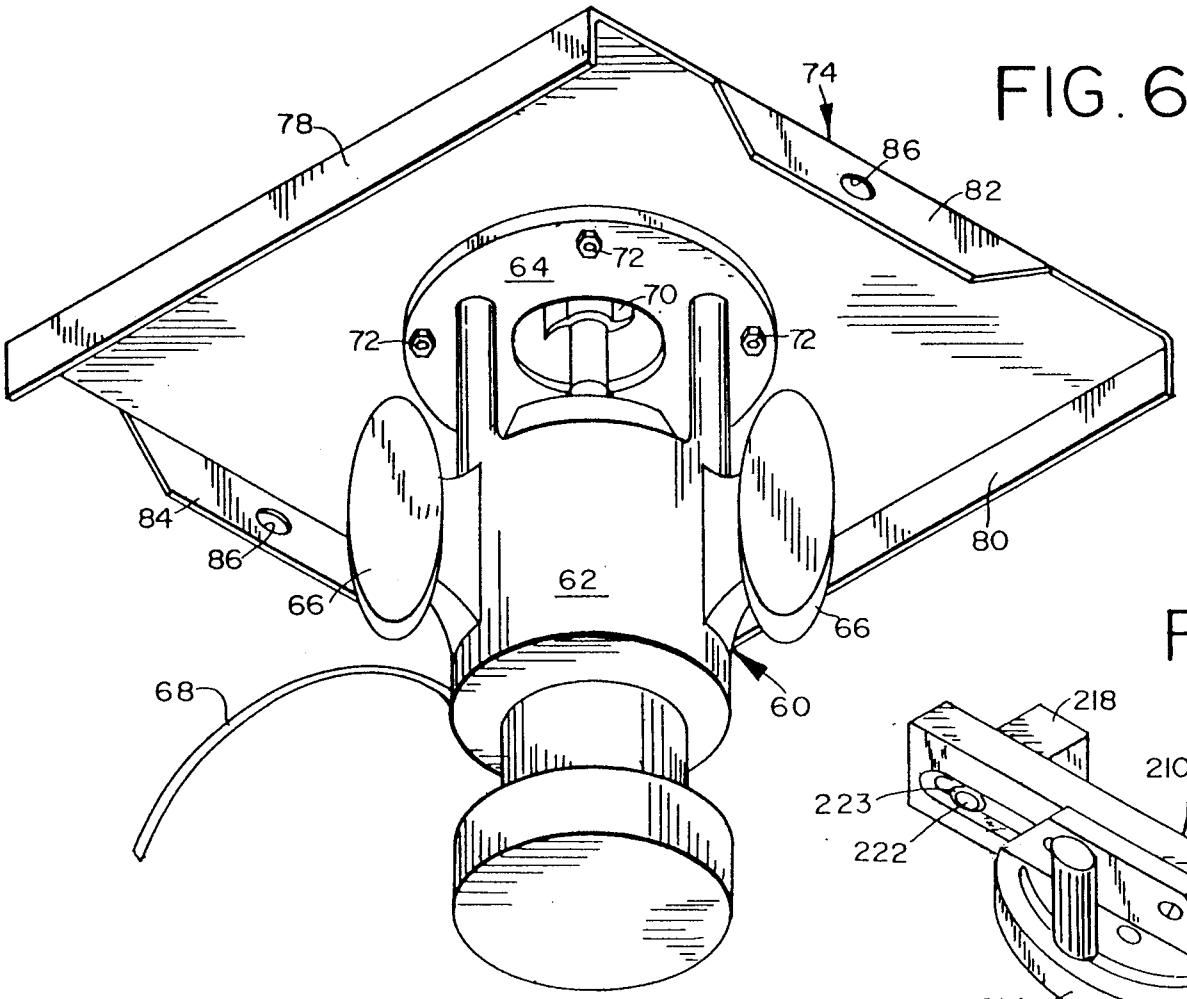
FIG. 6 is a bottom perspective view of a router as assembled with the mounting plate of the embodiment of FIGS. 1 through 5.

Although the present embodiment is easily adapted to receive other types of motorized hand tools (i.e. saber saw or rotary file) it is particularly useful with a hand router, such as that shown in FIG. 6. The router 60 is of standard construction, consisting of a motor section 62, a circular base 64, handles 66, power cord 68, depth of cut mechanism (not illustrated) and removable cutter 70 of such configuration as may be necessary to produce a desired edge cut on a work piece.

Attached to the base 64 by means of suitable flat head bolts or other fasteners 72 is a rectangular mounting plate 74 having a centrally disposed aperture 76 (see FIGS. 1 and 2) the diameter of which is approximately the same as or slightly smaller than the width of slot 50.

The mounting plate 74 preferably is stamped from sheet steel, and provided with oppositely facing offset or depending side flanges 78 and 80, and oppositely facing offset or depending end flanges 82 and 84. For reasons which will be apparent from the following description, the end flanges 82 and 84 do not extend completely across the ends of the mounting plate 74 but rather are short enough to provide a clear channel along each edge of the plate 74 proximate the side flanges 78 and 80. Further, centrally located in each end flange is a circular opening 86.

Figure 3:
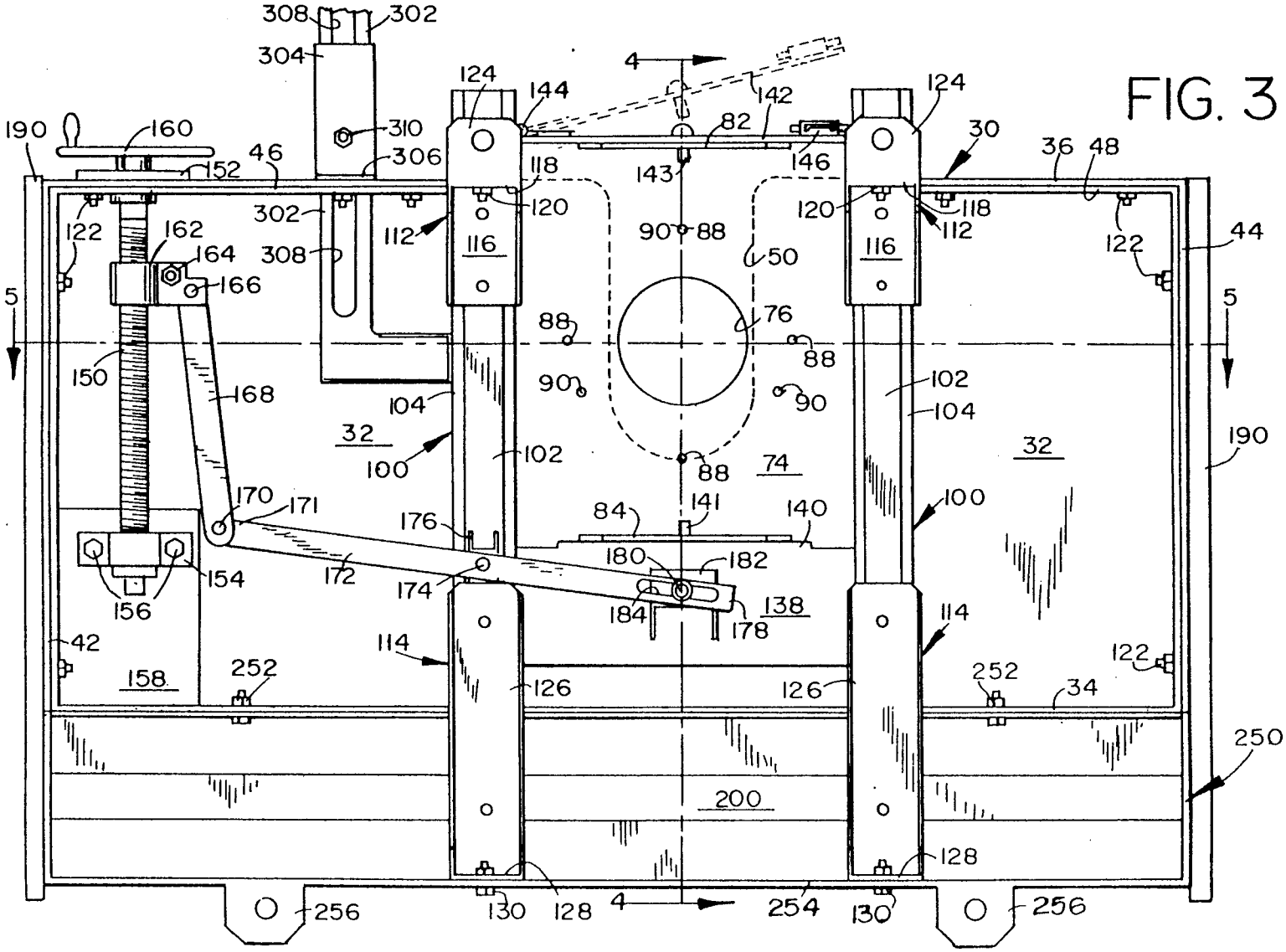
FIG. 3 is a bottom plan view of the embodiment of FIGS. 1 and 2 as combined with a supplemental table.

It will be noted from FIG. 3, in which the router 60 is not shown for clarity purposes, that a multiplicity of holes may be spaced in plate 74 to accommodate a variety of routers or other tools as may be mounted thereon. For instance, the four holes 88 would accommodate a router having a base which requires four bolts, whereas the three holes 90 (one also being marked 88) would accommodate a router base having provision for three bolts. Additional holes could be provided on different diameters to accommodate yet further routers or other suitable tools.

Track means comprising two slide assemblies 100 are fixed beneath the table 32, these assemblies being spaced apart on opposite sides of the slot 50 and positioned in a parallel relationship with one another and with the longitudinal axis of the slot.

Figure 5:
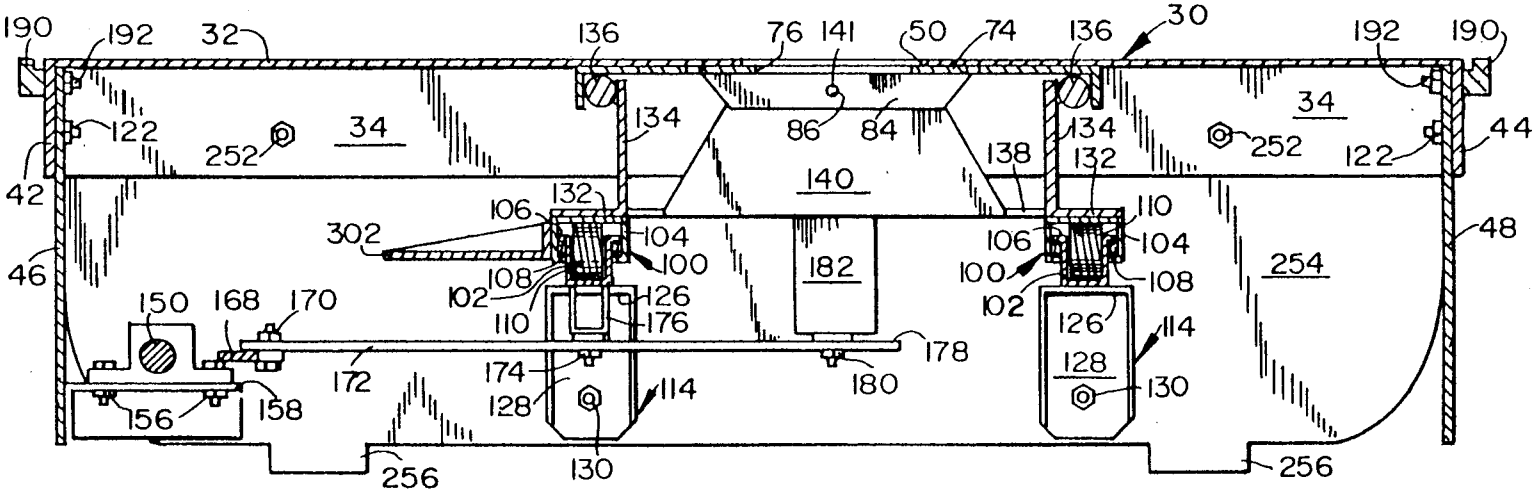
FIG. 5 is a cross sectional view as taken on the line 5—5 of FIG. 3.

Each slide assembly 100 comprises an elongate track section 102 having an elongate follower 104 supported for longitudinal movement thereon. As best seen in FIG. 5, in cross section the track sections 102 are generally channel shaped and upwardly open, with an outwardly projecting flange 106 along the upper edge of each side thereof.

The followers 104 also are generally channel shaped and are open downwardly, with an internal width slightly greater than the width of the track sections 102 across the flanges 106. The lower edge of each side of followers 104 is provided with an inwardly directed flange 108, which flanges 108 are disposed in an overlapping relationship with flanges 106. Between and separating the overlapping flanges 106 and 108 are a plurality of small anti-friction balls or bearing elements.

Disposed in the space between the parallel base sections of the channel members 102 and 104 are a plurality of wheel or disc like elements 110 which comprise short coil springs wound of a fairly substantial rectangular spring material. The normal diameter of the discs 110 is slightly greater than the distance between the base sections of channel members 102 and 104, whereby, the discs 110 are compressed slightly as they are assembled with channel members 102 and 104 whereby discs 110 not only bias the channel members apart but act as rollers or bearings between the channel members to permit smooth longitudinal movement therebetween.

Figure 4:
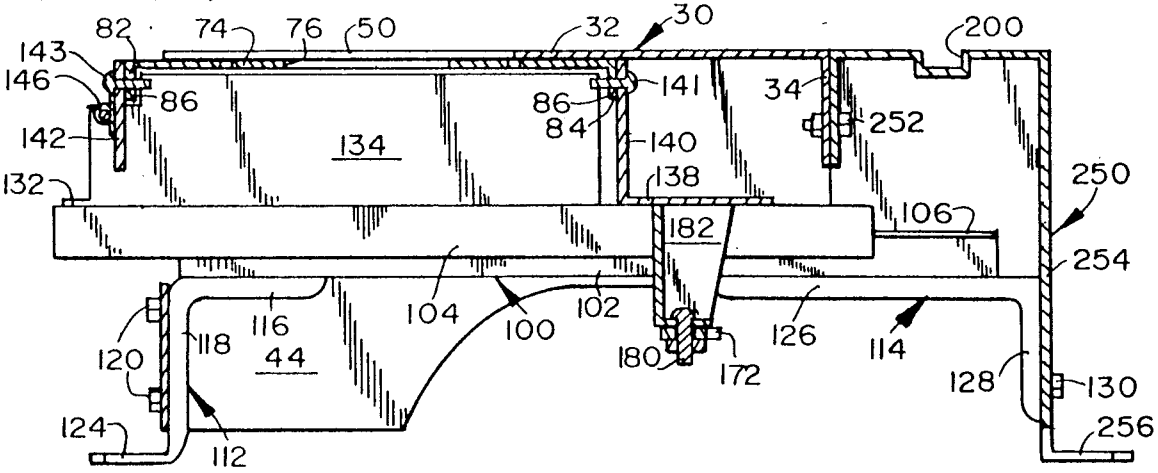
FIG. 4 is a cross sectional view as taken on the line 4—4 of FIG. 3.

As best illustrated in FIG. 4, the slide assemblies 100 are secured in position relative to table 32 by means of two sets of legs, outer legs 112 and inner legs 114. The outer legs 112 include a mounting portion 116 which is spot welded or otherwise secured to the lower surface of channel members 102 proximate their outer ends. Extending downwardly from mounting portion 116 is a connecting section 118, bolted or otherwise secured by fasteners 120 to the proximate skirt portions 46 and 48 which, in turn, are secured to the vertical edges 34, 36, 42 and 44 of table 32. On their lower end, connecting sections 118 terminate in outwardly projecting feet 124 which are preferably apertured for reception of a bolt in case it is desired to secure the machine 30 to a stand or table.

Inner legs 114 include a mounting portion 126 spot welded or otherwise secured to the lower surface of channel members 102 proximate their inner end. Extending downwardly from mounting portion 126 is a connecting section 128 which is bolted or otherwise secured by fasteners 130 to a table extension to be described hereinafter. Or in those cases where the machine 30 is mounted on a table saw, as in FIG. 1, the connecting sections 128 of legs 114 preferably are secured to the side of the saw base 16. Otherwise, they could be connected readily to table edges 34, 42 or 44 or to skirt portions 46 or 48.

Referring again particularly to FIGS. 4 and 5, each channel member or follower 104 has spot welded or otherwise secured to its upper surface the foot portion 132 of an "L" shaped support member having a support section 134 extending upwardly therefrom and terminating in an upper edge spaced a short distance below the lower face of table 32.

Extending along the upper edge of each support section 134, facing away from slot 50, is a circular section 136 which, in the illustrated embodiment, comprises a piece of round steel rod material. The rods 136 are positioned on supports 134 such that their periphery clears the lower surface of table 32 by a distance which is equal to or slightly greater than the thickness of the material from which the mounting plate 74 is fabricated.

The slide assemblies 100 and support members 134/136 carried thereon are spaced apart and symmetrically arranged relative to slot 50, such that the length of the span from the outer extreme surfaces of rods 136 is substantially the same as the distance between the inner faces of the side flanges 78 and 80 of mounting plate 74.

As will be apparent from the preceding description, the mounting plate 74 and tool 60 are assembled with the machine 30 by pushing plate 74 into the space between the lower face of table 32 and upper surface of rods 136, with the side flanges 78 and 80 straddling and lightly contacting the outer periphery of the rods.

The fit of the mounting plate on the rods 136 and against the proximate lower face of table 32 will provide a secure frictional fit of the mounting plate and restrain the plate 74 from any undesirable transverse movement relative to the rods 136. Obviously, however, the tightness of the fit should not be such that it is difficult to place the plate 74 in or remove the plate from the machine 30.

Means for latching or securing the mounting plate 74 against unintended movement longitudinally of rods 136 and the support components associated therewith include a bridge section 138 which spans between and is connected to followers 104 inwardly of support member 132/134. Bridge section 138 thus connects followers 104 to insure that they move uniformly as a unit relative to the track sections 102.

A stop member 140 extends upwardly from bridge section 138 to a position where it will abut one of the end flanges 82/84 of mounting plate 74 as the plate is being placed in the machine 30. Such abutment will thus stop plate 74 in and restrain it from moving beyond its operational position relative to its support means.

Means for latching or securing plate 74 in its operational position is provided by a closure or gate member 142 which is journaled at one end on one of the support sections 134 by hinge 144 for rotary movement between an open position wherein the mounting plate 74 and tool 60 can be inserted into or removed from the machine 30, and a closed position. In its closed position, gate 142 will abut the other of the end flanges 82/84 and thus latch the plate 74 against any longitudinal movement relative to supports 134 and rods 136.

Carried by stop member 140 and gate 142 are pins 141 and 143, respectively, which pins are positioned to enter circular openings 86 in mounting plate 74 upon assembly of the plate 74 with the machine 30 and closure of gate 142. Pins 141 and 143 thus provide yet further assurance against inadvertent movement of plate 74 and tool 60 during use of the machine.

Although various other arrangements could be used to latch the gate 142 in its closed position, in the illustrated embodiment there is shown a slide bolt mechanism 146 adapted to cooperate with an approximately placed hole in the other support 134.

As stated previously in this description, it may often be necessary or desirable to move the position of the tool 60 and its cutter 70 relative to the table rather than or in addition to moving the fence or guide (described hereinafter) relative to the table 32.

For this purpose, there is provided means for moving the tool 60, mounting plate 74, support means 132/134/136 and followers 104 longitudinally along the track sections 102 thereby moving the cutter 70 longitudinally along the slot 50. Such means, in the illustrated embodiment, comprises an elongate threaded shaft 150 journaled in a horizontal position on its outer end by bearing 152, supported on skirt 46, and on its inner end by bearing 154, mounted by suitable fasteners 156 on plate 158. Externally of skirt 46, shaft 150 is provided with a manually rotatable hand wheel 160 of a type commonly found on machine tools.

Riding on shaft 150 is a threaded take-off nut 162 which preferably is split on one side to provide a limited degree of flexure. Thus by the use of bolt 164 the nut 162 can be tightened periodically on shaft 150 to compensate for any wear therebetween.

Journaled on nut 162 by pin 166 is one end of a link 168 which, in turn, is journaled by pin 170 to a first end 171 of a second link 172. This second link 172 is journaled approximately at its mid-point on pin 174 which is carried on pin support 176. In turn, pin support 176 is welded or otherwise rigidly affixed to track section 102. Pin 174 thus forms a fulcrum around which link 172 will rotate in a limited arc as the take-off nut 162 and link 168 move along shaft 150 as shaft 150 revolves in response to manual rotation of hand wheel 160. Depending upon the direction in which hand wheel 160 is rotated, the end 178 of link 172 beyond pin 174 will rotate inwardly or outwardly relative to the table 32.

Pin 180 is mounted on column 182 which, in turn, is welded or otherwise affixed to bridge section 138. As best shown in FIG. 3, pin 180 is slidably received in slot 184 in end 178 of link 172. It will be obvious, therefore, that bridge section 138, followers 104, support means 132/134/136, mounting plate 74, tool 60 and cutter 70 will move longitudinally along track sections 102 and slot 50 as link end 178 rotates around pin 174 in response to rotation of hand wheel 160. Although the distance of travel of these various components is not of any major significance with respect to this invention, in the present embodiment such travel ranges in the area of 3" to 3¼" (76.2 mm to 82.6 mm).

Referring now to FIG. 1, the machine 30 is there shown as being mounted on the right side of the saw table 12. This is the preferred position as it will allow someone working from the front of the saw 10 to feed the work piece 31 into the advancing cutting edges of the cutter 70 against the cutter's rotation (normally counter-clockwise) instead of with the cutter's rotation. The latter direction of feed (with the cutter's rotation) is not desirable as it can lead to rough cuts and too rapid an advancement of the work piece.

Figure 2:
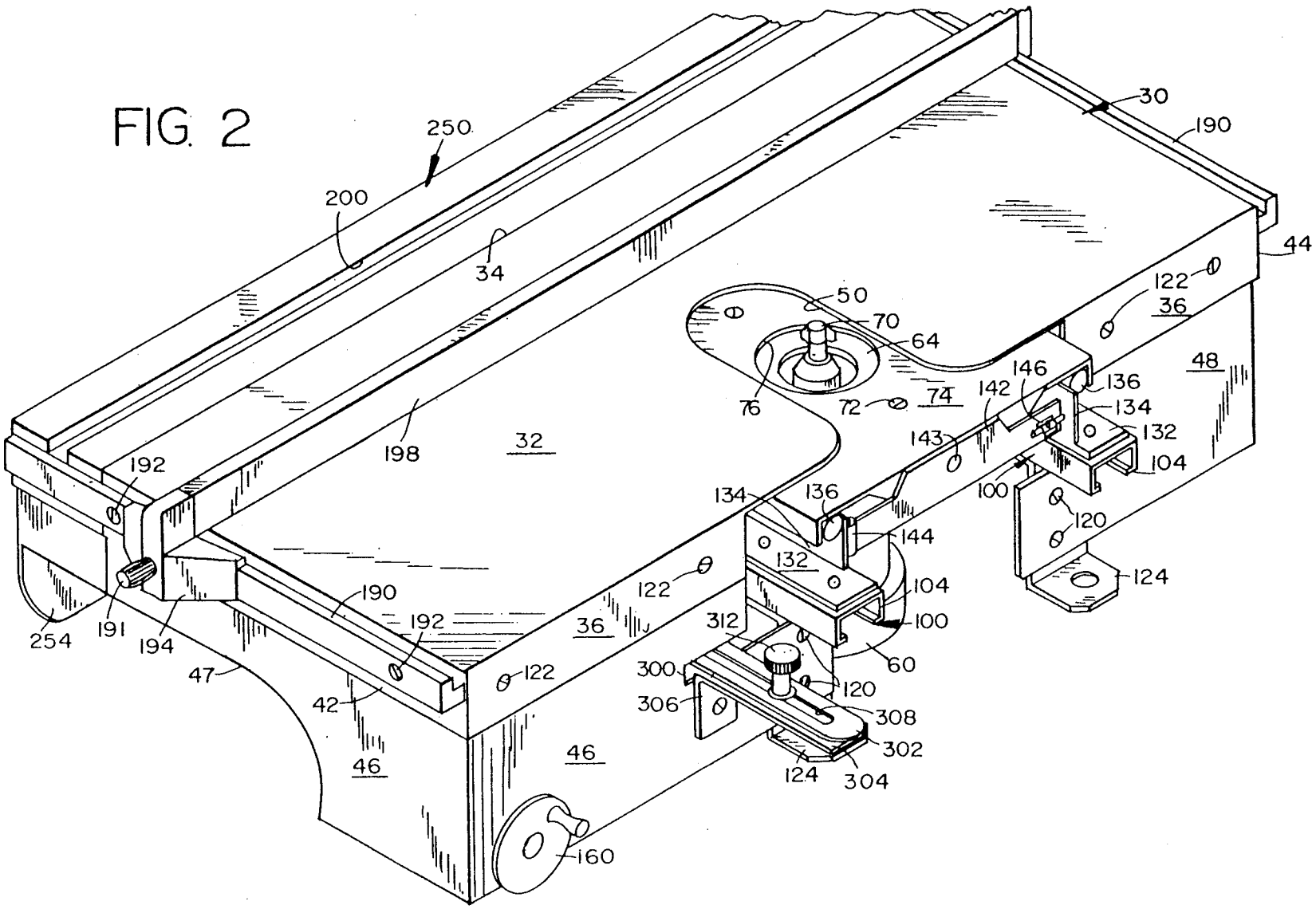
FIG. 2 is an enlarged perspective view of a woodworking machine constructed in accordance with the embodiment of FIG. 1, as combined with a supplemental table.

In order to avoid interference with the use of hand wheel 24 of saw 10 to tilt the blade 20, the back portion of skirt 46 along front side 42 is of reduced width, as at 47. Also, as best illustrated in FIGS. 2 and 3, the slot 50 and all operational structure associated therewith are not centrally located with reference to outer edge 36 of table 12 but rather are offset toward back edge 44.

Extending along the front and back edges of the work surface provided by the combined saw table 12 and machine table 32 are elongate rails 190 which are held in position by flat head bolts or other suitable fasteners 192.

As will be understood by those in the woodworking field, rails 190 are adapted to slidably receive the end portions 194 and 196 of an elongate guide or fence 198 which extends across the work surface perpendicular to the rails 190 and the longitudinal axis of slot 50. Fence 198, of course, is movable throughout the length of the aforesaid work surface and hence can be used either in sawing a work piece with blade 20 or in shaping a work piece with cutter 70. In most instances, when the saw is to be used, the mounting plate 74 and router 60 should be removed from the machine 30 to provide a clear, safe and unencumbered work area. Alternately, when the router is to be used, the blade 20 should be lowered to below the surface of table 12.

When used with the machine 30, the fence or guide 198 normally will be toward the right hand end of the work surface, clamped to the rails 190 by hand clamp 191 to provide a solid support for the work piece as it is fed into engagement with the cutter 70. Thus, even if a fairly deep cut should be taken, there is no danger that the work piece will vibrate and "float" under the high frequency impacts of the cutter 70 (normally revolving at 20,000 to 25,000 R.P.M.) as it bites into the work piece. With the usual two piece router fence straddling the cutter, reduction of vibration and "floating" of the work piece is difficult unless substantial manual pressure is put on the work piece. As pointed out heretofore, such two piece fences and the pressures necessary for their use are quite unsatisfactory and troublesome, at best.

One of the important advantages of the present invention is that the position of the cutter 70 in slot 50 can be adjusted quickly and conveniently yet in a very precise controlled manner should it be desired to vary the distance between the cutter 70 and fence 198 after it has been positioned. Thus, without moving the fence 198 (a process which is difficult to do with precision) the edge of a work piece can be routed gradually through a series of small cuts should the work piece be quite hard or should a series of small cuts be necessary for some other reason, as to obtain a precise fit between parts. In effect, therefore, fence 198 can be set to provide an initial coarse cut, and the router 60 and cutter 70 then moved toward the fence to adjust for any necessary finishing cuts.

Figure 7:
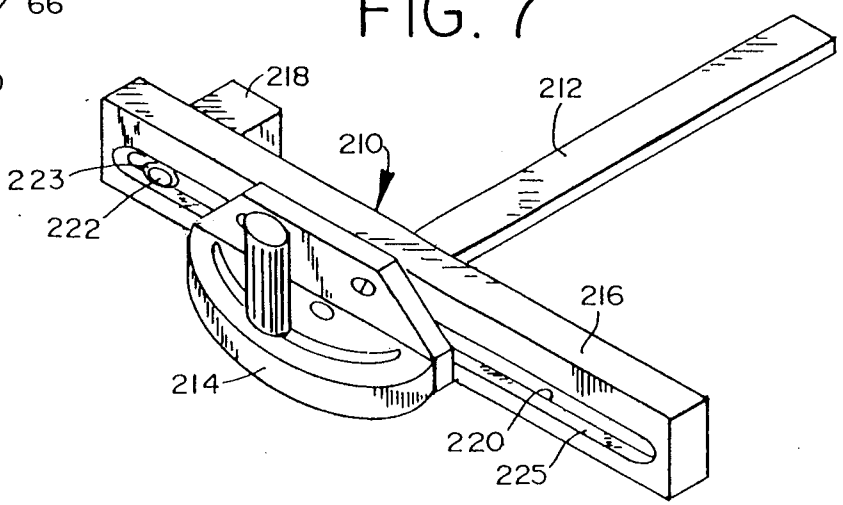
FIG. 7 is a perspective view of a miter gauge as adapted for use as a guide member with the embodiment of FIGS. 1 through 6.

Particularly if it should be necessary to route a short work piece or the end of a work piece, it may be desirable to use a miter gauge type of guide rather than the fence type discussed hereabove. In this event, the guide will be used in combination with groove 200, one of the two grooves normally provided proximate to the sides of the main or primary table of the usual table saw. A miter gauge 210 (see FIG. 7) is provided with a rectangular bar 212 sized to slide in groove 200, and a head portion 214 pivoted for limited rotary movement on bar 212.

As the head portion 212 of the usual miter gauge is relatively short in length, for purposes of the present invention it is desirable to bolt to the head portion 212 an elongate bar 216 having mounted thereon a stop 218. The stop 218 is movable along substantially the full length of bar 216 by virtue of an elongate slot 220 through which extends a screw 222. Carried on the head of screw 222 is a flat washer 223 which rides in the recessed area 225 formed along both edges of slot 220. The opposite end of screw 222 preferable carries a wing nut, or the like (not shown), for use in tightening the screw 222 and hence positioning the stop 218 at such location on the bar 216 as may be necessary to abut the end or edge of the work piece to be routed. As with the fence type guide, after the block 218 has been initially set for the first cut, the router 60 and its cutter 70 can thereafter be moved toward the groove 200 in taking additional cuts.

As discussed heretofore, in some instances it may not be desired to mount the machine 30 on a table saw but rather to use it as a separate independent machine. In this event, the table 32 could be made somewhat larger and provided with an integral groove 200. Instead of enlarging the table 32 and possibly making the machine too large or bulky for later attachment to a saw, however, it is preferred to supply a table extension 250 and to form the groove 200 in that extension. The extension 250 is of the same length as and mounted on inner edge 34 of table 32 by suitable bolts 252. As will be noted, particularly from FIGS. 2, 3, and 4, the table extension 250 preferably is of such width that its back surface 254 will contact the connecting sections 128 of inner legs 114, with such sections then being connected to back surface 254 by bolts 130.

Extending rearwardly from and integral with back surface 254 are a pair of apertured feet 256 which are coplanar with feet 124 on the other side of the machine.

Rails 190 of a length to fit the combined tables 32 and 250 should then be mounted along the front and back edges of the tables perpendicular to the outer edge 36 for use with guide fence 198.

Extending through a tranverse slot 300 in skirt 46 is a gauge member 302 which preferably carries a series of marks (not shown) which are useful in indicating to the user the distance by which the router 60 and cutter 70 have moved in response to manual rotation of hand wheel 160. As will be noted particularly from FIG. 3, gauge member 302 is fixed to follower 104 and thus is movable conjointly with the follower as it is moved as part of the assembly for moving the router 60.

Preferably, underlying the gauge 302 is a support member 304 having a mounting portion 306 bolted to skirt 46. Extending through slot 308 of gauge 302 is a threaded bolt 310 on which a manually rotatable handle 312 is mounted. As will be understood, after router 60 and the components movable therewith have been moved to a desired position, the nut 312 preferably should be tightened onto gauge 302 to positively hold the movable components in that position.

Obviously many modifications and variations of the present invention are possible in light of the teachings of this specification. Also, it will be understood that instead of a router, other machines, such as a saber saw or rotary file, could be used. It is to be understood, therefore, that the foregoing description and appended drawings are for illustrative purposes only and are neither intended nor desired to limit the scope of this invention. Thus, having described certain preferred embodiments of the invention, what is claimed as new and novel and desired to be protected by Letters Patent is as follows.

I claim:

1. A woodworking machine for use with a motorized tool of the type having an axially projecting cutter, said machine comprising a relatively fixed table having an elongate opening extending transversely relative to and through one edge of said table, means for releasably supporting said tool beneath said table with said cutter projecting through said elongate opening, means for moving said tool horizontally beneath said table in a direction effective to shift said cutter longitudinally along and selectively position said cutter within said opening, and means movable longitudinally of said opening between various selective positions spaced from said cutter for engaging one edge of a work piece and restraining said work piece against backlash and vibration upon operational engagement between another edge of said work piece and said cutter.

2. A woodworking machine according to claim 1 characterized by said tool support means comprising a mounting plate secured to said tool, and means for releasably holding said mounting plate beneath said table in a vertically fixed but horizontally movable relationship with said table.

3. A woodworking machine according to claim 2, characterized by said tool being releasably mounted on the lower face of said mounting plate with said cutting element projecting through an aperture in said plate, and said holding means positioning said mounting plate proximate the lower face of said table with said aperture underlying said opening.

4. A woodworking machine according to claim 3, characterized by said table being generally rectangular and said opening comprising a slot extending transversely relative to and through one edge of said table.

5. A woodworking machine according to claim 4, characterized by said moving means comprising track means fixed beneath said table in a generally parallel relationship with the longitudinal axis of said slot, follower means moveable longitudinally along said track means, said holding means being movable with said follower means longitudinally along said track means, and manually operable control means for conjointly moving said follower means, said holding means, said mounting plate and said tool longitudinally along said track means in response to the manual actuation of said control means.

6. A woodworking machine according to claim 5, characterized by said track means comprising a pair of elongate track sections fixed beneath said table in a spaced relation on opposite sides of said slot, said follower means comprising a pair of elongate followers supported by said track sections for longitudinal movement relative thereto, said holding means comprising a support member fixed to each of said followers and operatively engaging said mounting plate, said control means operatively engaging said followers and conjointly moving said followers, said support members, said mounting plate and said tool along said track sections in a direction parallel to said slot to selectively move said cutter longitudinally along said slot upon manual actuation of said control means.

7. A woodworking machine according to claim 6, characterized by said mounting plate being generally rectangular and provided with oppositely facing offset side flanges, said aperture being generally centrally located in said plate, and said support members extending upwardly from said followers into releasable engagement with said side flanges.

8. A woodworking machine according to claim 7, characterized by said side flanges depending from said plate and frictionally engaging said support members to restrain said plate against movement transversely of said slot, and means for selectively latching said plate against longitudinal movement relative to said support members as said support members are moved with said followers upon manual actuation of said control means.

9. A woodworking machine according to claim 8, characterized by said control means providing a bridge section fixed to and operatively joining said followers, said latching means comprising a stop carried by said bridge section for engagement with one end of said mounting plate, and closure means carried by and movable relative to said support members between open and closed positions, said closure means engaging the other end of said mounting plate when disposed in its closed position whereby said stop and said closure means are effective to prevent relative longitudinal movement between said support members and said mounting plate.

10. A woodworking machine according to claim 9, characterized by said ends of said mounting plate terminating in oppositely facing offset end sections, said closure means comprising a gate member hinged to one of said support members for rotation between its said open and closed positions, and means for selectively securing said gate member in its said closed position, said stop and said gate member engaging said offset end sections of said mounting plate to restrain said plate and tool against longitudinal movement relative to said support members when said plate is disposed on said support members and said gate member is secured in its said closed position, said mounting plate and said tool being disengagable from said support members and said stop and removable from said machine when said gate member is disposed in its said open position.

11. A woodworking machine according to claim 10, characterized by said control means comprising a manually rotatable drive member, a driven member carried by said bridge section, means linking said drive member and said driven member and converting rotary movement of said drive member to linear movement of said driven member, said driven member, bridge section, followers, support members, mounting plate and tool moving as a unit horizontally relative to said table in a direction parallel to the longitudinal axis of said slot upon manual rotation of said drive member, and gage means for visually determining the position of said follower unit and for releasably securing said unit in a selected position relative to said table.

12. A woodworking machine according to claim 1, characterized by said restraining means comprising guide means selectively positionable relative to said table remote from said cutter, and support means for holding said guide means in a selected position against the pressure exerted thereon by said work piece in reaction to the pressure exerted on said work piece by said cutter during cutting engagement between said cutter and said work piece.

13. A woodworking machine according to claim 12, characterized by said elongate opening comprising a slot, said support means comprising a groove extending across said table transversely of and remote from said slot, and said guide means being movable across said table in sliding engagement with said groove, and provided with a stop member selectively positionable thereon in a direction generally transversely of said groove and engagable with said one edge of said work piece to provide said support for said work piece.

14. A woodworking machine according to claim 13, characterized by said guide means comprising a miter gauge having a bar slidingly disposed in said groove, a head portion carried by and pivoted for limited rotary movement on said bar, and means for releasably positioning said stop on said head portion in a position selectively remote from said cutter.

15. A woodworking machine according to claim 12, characterized by said support means comprising at least one rail extending along an edge of said table transversely of said one edge, said guide means comprising an elongate fence extending across said table transversely of and engaging said rail, said fence being slidingly supported by said rail for movement over said table along said rail, and provided with means for releasably clamping said fence to said rail upon manual movement of said fence to a selected position.

16. A woodworking machine according to claim 12, characterized by said support means comprising an elongate rail extending along each edge of said table transversely of said one edge, said guide means comprising an elongate fence extending across said table transversely of and engaging both said rails, said fence being movable over said table along said rails, and provided with end portions slidingly engaging said rails during movement of said fence over said table and releasably gripping said rails upon disposal of said fence in a selected position.

17. A woodworking machine according to claim 12, characterized by said support means comprising an elongate support element extending along an edge of said table transversely of said one edge, and another support element extending across said table transversely of said first support element, said guide means being in slidable engagement with and supported for linear movement over said table by one of said support elements.

18. A woodworking machine for use with a motorized tool of the type having an axially projecting cutter, said machine comprising a generally rectangular work table having an elongate slot extending transversely relative to and through one edge thereof, means for releasably securing said tool beneath said table with said cutter projecting upwardly through said slot, track means positioned beneath said table in a generally parallel relationship with said slot, follower means slidable longitudinally relative to said track means, said tool securing means and said tool being carried by and movable with said follower means, manually operable control means for moving said follower means and said tool securing means and tool as a unit longitudinally of said track means to shift said cutter longitudinally along and selectively position said cutter within said slot, and guide means selectively positionable relative to said table remote from said cutter for restraining a work piece against vibration and backlash upon operational engagement between said work piece and said cutter.

19. A woodworking machine for use with a motorized tool of the type having an axially projecting cutter, said machine including a relatively flat rectangular work surface comprised of at least two generally rectangular table sections connected conjointly edge-to-edge in a coplanar relationship, the first of said table sections having a free outer edge with an elongate slot extending transversely relative to and through said outer edge, means for releasably securing said tool beneath said first table with said cutter projecting upwardly through said slot, and means for selectively moving said tool in a direction effective to shift said cutter longitudinally along and selectively position said cutter within said slot.

20. A wood working machine according to claim 19, characterized by means for restraining a work piece against backlash and vibration upon operational engagement between said work piece and said cutter, said restraining means comprising a groove extending across said work surface tranversely of and remote from said slot, guide means movable across said work surface in sliding engagement with said groove, and a stop member carried by said guide means, said stop member being selectively positionable on said guide means in a direction generally transverse of said groove.

21. A woodworking machine according to claim 20, characterized by said conjointly connected edges of said table sections being of substantially the same length, said groove being provided in the second of said table sections adjacent to and parallel with said connected edges, an elongate rail extending along each edge of said connected table sections transversely of said outer edge, an elongate fence extending across said work surface transversely of and in sliding engagement with said rails.

22. A woodworking machine according to claim 19, characterized by said second table section being the table of a table saw of the type having a saw blade retractable to a position below said work surface, said connected edges of said table saw table and said one table being substantially equal in length, means for restraining a work piece against backlash and vibration upon operational engagement between said work piece and said cutter, said means comprising an elongate rail extending along both edges of said work surface transversely of said outer edge, an elongate fence extending across said work surface transversely of and engaging both said rails, said fence being movable over said work surface along said rails and provided with end portions slidingly engaging said rails during movement of said fence and releasably gripping said rails upon disposition of said fence in a selected position.

23. A woodworking machine according to claim 22, characterized by said motorized tool comprising a router wherein said cutter rotates at a high speed in a counter-clockwise direction, said first table section being connected to the right hand end of said second table section, said elongate slot and structure associated therewith being offset rearwardly of the midpoint of said outer edge to avoid interference with the tilt wheel control generally disposed adjacent the front lower corner of the right hand side of the usual table saw.

* * * * *